US005358241A

United States Patent [19]

Anghelo et al.

[11] Patent Number: 5,358,241

[45] Date of Patent: Oct. 25, 1994

[54] HELICAL MONORAIL RAMP FOR A PINBALL GAME

[75] Inventors: Python V. Anghelo, Chicago; Raymond J. Czajka, Hometown, both of Ill.

[73] Assignee: Williams Electronics Games, Inc., Chicago, Ill.

[21] Appl. No.: 134,984

[22] Filed: Oct. 12, 1993

[51] Int. Cl.[5] ..... A63F 7/30

[52] U.S. Cl. ..... 273/118 R; 273/127 R; 273/121 R; 446/168

[58] Field of Search ..... 273/108, 112, 118–125, 273/127 R, 127 B, 127 C; 446/168, 170, 138

[56] References Cited

U.S. PATENT DOCUMENTS

| | | | |
|---|---|---|---|
| 407,713 | 7/1889 | Wilson | 273/120 R |
| 432,483 | 7/1890 | Fitler | 273/112 |
| 1,252,158 | 1/1918 | Okel | 273/120 R |
| 3,028,704 | 4/1962 | Rumbaugh | 273/118 R |
| 3,135,512 | 6/1964 | Taylor | 273/112 |
| 4,120,501 | 10/1978 | Atherton | 273/120 R |
| 4,175,665 | 11/1979 | Dogliotti | 446/168 X |

FOREIGN PATENT DOCUMENTS

| | | | |
|---|---|---|---|
| 88754 | of 1896 | Fed. Rep. of Germany | 273/120 R |
| 2922648 | 12/1980 | Fed. Rep. of Germany | 446/168 |
| 464766 | of 1914 | France | 273/120 R |
| 1077502 | 11/1954 | France | 273/112 |

*Primary Examiner*—Vincent Millin
*Assistant Examiner*—Raleigh W. Chiu
*Attorney, Agent, or Firm*—Rockey, Rifkin and Ryther

[57] ABSTRACT

The ramp consists of a wire rail formed as a helix. The rail extends between a first elevation where the ball enters the ramp to a second, lower elevation where the ball exits the ramp. A straight rail extends through the center of the helical rail for the length thereof. The helical rail is dimensioned such that the distance between it and straight rail is less than the diameter of the ball. As a result, the ball will contact both the straight rail and helical rail simultaneously as it rolls down the helical rail by the force of gravity.

7 Claims, 2 Drawing Sheets

HELICAL MONORAIL RAMP FOR A PINBALL GAME

BACKGROUND OF THE INVENTION

The invention relates, generally, to pinball games and, more particularly, to a play feature for such games.

The typical pinball game consists of an inclined playfield supporting a plurality of play features such as targets, bumpers, ramps and the like, a rolling ball and player controlled flippers. The player operates the flippers to direct the ball at selected play features thereby to score points and control play of the game.

As will be apparent, the success of a manufacturer's line of pinball games depends, in part, on its ability to create new and exciting play features and game schemes that will attract players to its games. Thus, it is necessary for game designers to continuously develop new features for use in their games.

Many existing games have multiple levels which support the rolling ball that are defined by elevated ramps, play features, playfield sections or the like. Thus, mechanisms for transferring the ball between the different levels are required. While numerous ramps and ball raising and lowering devices have been developed, a new apparatus for moving a ball quickly from a first elevation to a second elevation is desired.

SUMMARY OF THE INVENTION

The ramp of the invention consists of a wire rail formed as a helix. The rail extends between a first elevation where the ball enters the ramp to a second, lower elevation where the ball exits the ramp. A second vertical rail extends through the center of the helical rail for the length thereof. The helical rail is dimensioned such that the distance between it and vertical rail is slightly less than the diameter of the ball. As a result, the ball will contact both the straight rail and helical rail simultaneously as it rolls down the helical rail by the force of gravity.

DETAILED DESCRIPTION OF THE INVENTION

Figure 1:
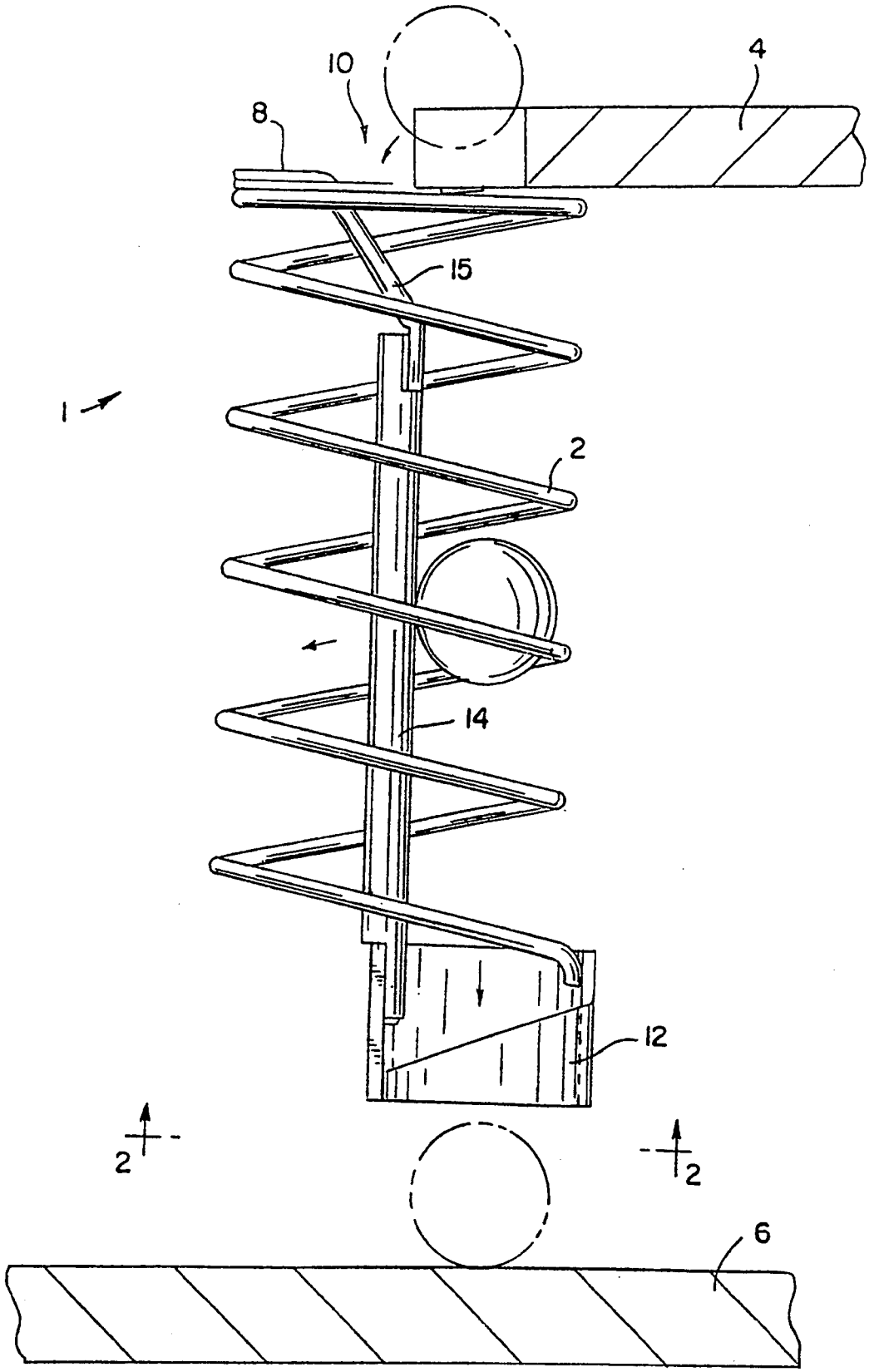
FIG. 1 is side view of the helical ramp of the invention.
Figure 2:
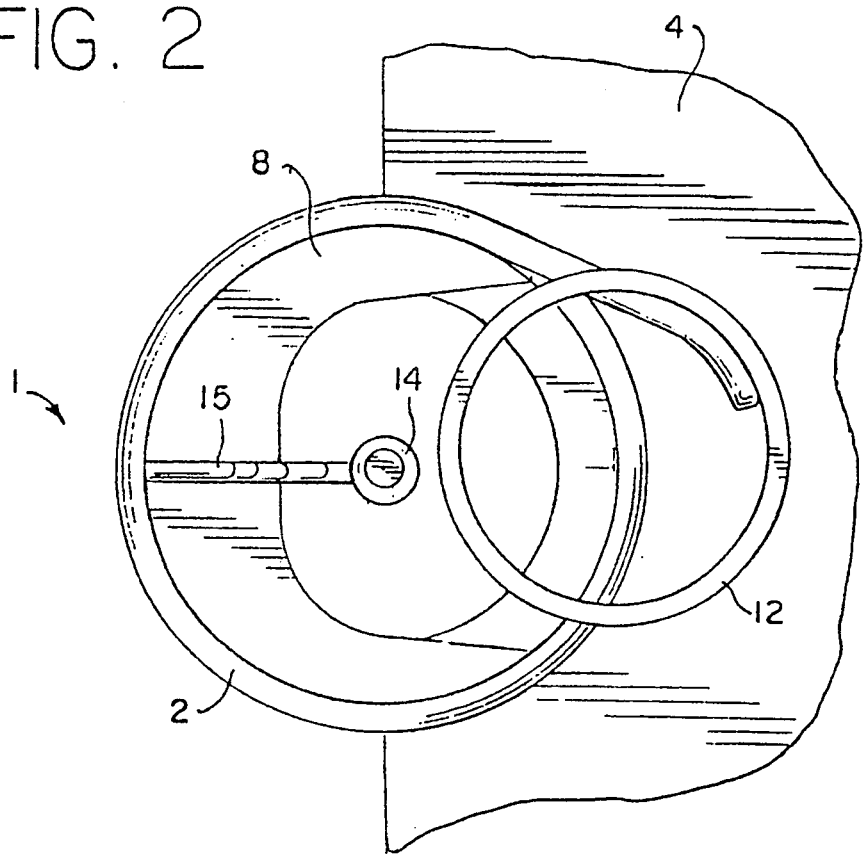
FIG. 2 is a bottom view of the helical ramp of the invention taken along line 2—2 of FIG. 1.

The helical ramp of the invention is shown generally at 1 consisting of a first rail 2 formed in a helical shape. Rail 2 can be formed of any rigid material such as steel or aluminum and extends between a first, upper ball supporting surface 4 and a second, lower ball supporting surface 6. In the illustrated embodiment surface 2 is an elevated playfield and surface 4 is the main playfield. It will be appreciated, however, that the first and second surface could be ramps, other playfield features or any other ball supporting surfaces.

A ball guide 8 or other suitable structure is provided adjacent the first or inlet end 10 of the helical rail 2 to guide the ball from upper surface 4 to the helical ramp. In the illustrated embodiment, the helical rail terminates in a second ball guide 12 spaced above lower surface 6. Ball guide 12 stops the horizontal component of the ball's velocity to drop the ball onto surface 6. In the preferred embodiment, the distance between the bottom of the ball guide 12 and the lower surface 6 is large enough to create a space that allows a ball to pass under the ramp. It will be appreciated that ball guide 12 could be eliminated to allow the ball to "fly" off the end of the ramp or the ramp could be extended so as to contact the lower surface 6.

A second straight rail 14 extends through the center of helical rail 2 for substantially the length thereof. Like rail 2, rail 14 can be made of any rigid material. A guide bar 15 is located between helical rail 2 and straight rail 14 near inlet end 10 and is angled relative to the vertical. Guide bar 15 facilitates the entry of a ball into the ramp.

Figure 3:
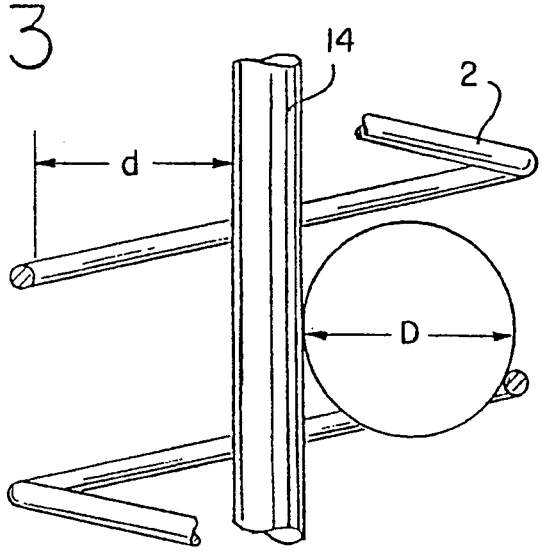
FIG. 3 is a partial section view of the helical ramp of the invention showing the relationship between a ball and the ramp as the ball rolls down the ramp.

Helical rail 2 is dimensioned such that the transverse distance d between it and center rail 14 is slightly less than the diameter D of the ball as best shown in FIG. 3. As a result, a ball entering ramp 1 will simultaneously contact both helical rail 2 and center rail 14 and be supported therebetween as it traverses the ramp as shown in the figure. Thus, the ball will follow the path of the helical rail 2 as it rides along the helical rail 2 and rotates about center rail 14.

The helical ramp of the invention can lower a ball very quickly thereby speeding up play of the game and creating an exciting visual effect. Moreover, the helical ramp 1 can lower a ball through a great distance without occupying much room on the playfield thereby conserving space for other play features unlike ramps in the prior art.

While the invention has been described in some detail with reference to the figures, it will be appreciated that numerous changes in the details and construction of the device can be made without departing from the spirit and scope of the invention.

What is claimed is:

1. A play feature for a pinball game, comprising:

a) a rolling ball;

b) a first surface for supporting the rolling ball;

c) a second surface for supporting the rolling ball disposed below the first surface;

d) a straight rail extending substantially from the first surface to the second surface; and e) a helical rail surrounding said straight rail, said helical rail being spaced from said straight rail such that the transverse distance between the straight rail and the helical rail is less than the diameter of the ball, the ball being suspended between and in rolling contact with said first and second rails.

2. The ramp according to claim 1, wherein said straight rail is vertical.

3. The ramp according to claim 1, wherein the straight rail is located in the center of the helical rail.

4. The ramp according to claim 1, further including guide means for guiding said ball from said first surface to said rails.

5. The ramp according to claim 1, wherein said straight rail and said helical rail terminate above said second ball supporting surface to create a space therebetween.

6. The ramp according to claim 5, wherein the space between the rails and the second ball supporting surface is sufficient to allow a ball to pass beneath the rail.

7. The ramp according to claim 5, further including means to stop the horizontal component of the ball's velocity at the lower end of said ramp to allow the ball to drop onto said second surface.

* * * * *